US011285370B2

(12) United States Patent
Shorma

(10) Patent No.: US 11,285,370 B2
(45) Date of Patent: Mar. 29, 2022

(54) TRAMPOLINE FRAME PADS

(71) Applicant: Rush Company, Inc., Springfield, SD (US)

(72) Inventor: William Shorma, Springfield, SD (US)

(73) Assignee: Rush Company, Inc., Springfield, SD (US)

( * ) Notice: Subject to any disclaimer, the term of this patent is extended or adjusted under 35 U.S.C. 154(b) by 116 days.

(21) Appl. No.: 16/872,016

(22) Filed: May 11, 2020

(65) Prior Publication Data

US 2020/0360793 A1 Nov. 19, 2020

Related U.S. Application Data

(60) Provisional application No. 62/846,951, filed on May 13, 2019.

(51) Int. Cl.

| | |
|---|---|
| ***A63B 71/00*** | (2006.01) |
| ***A63B 6/00*** | (2006.01) |
| ***A63B 5/11*** | (2006.01) |

(52) U.S. Cl.

CPC ..... *A63B 71/0054* (2013.01); *A63B 6/00* (2013.01); *A63B 5/11* (2013.01); *A63B 2071/009* (2013.01); *A63B 2071/0063* (2013.01); *A63B 2209/10* (2013.01); *A63B 2225/76* (2020.08)

(58) Field of Classification Search

CPC .... A63B 5/11; A63B 5/00; A63B 5/02; A63B 5/08; A63B 71/0054; A63B 71/023; A63B 2071/0063; A63B 2071/009; A63B 2209/10; A63B 2225/76; A63B 6/00; A63B 6/02; A63B 6/025

See application file for complete search history.

(56) References Cited

U.S. PATENT DOCUMENTS

| | | | | |
|---|---|---|---|---|
| 3,891,208 | A * | 6/1975 | Sidlinger | A63B 5/11 482/27 |
| 4,331,329 | A * | 5/1982 | Mirkovich | A63B 5/11 482/27 |
| 6,193,632 | B1 * | 2/2001 | Steger | A63B 5/11 482/27 |
| 7,494,445 | B1 * | 2/2009 | Chen | A63B 5/11 482/27 |
| 8,911,331 | B2 * | 12/2014 | DeBlanco | A63B 5/11 482/27 |

(Continued)

*Primary Examiner* — Megan Anderson

(74) *Attorney, Agent, or Firm* — Michael A. Bondi; Moss & Barnett

(57) ABSTRACT

A trampoline frame pad system for use in conjunction with a trampoline having a jumping mat that is operably attached to a support frame. The trampoline frame pad system includes a foam core, a protective cover, a cover tightening mechanism and a primary pad attachment mechanism. The foam core has a first surface. The protective cover has an opening that is adapted to receive the foam core. The cover tightening mechanism is attached to the protective cover so that the cover tightening mechanism is capable of substantially tightening the protective cover over the first surface without the cover tightening mechanism extending over the first surface. The primary pad attachment mechanism is attached to the protective cover so that the primary pad attachment mechanism is capable of removably attaching the trampoline frame pad to the support frame.

19 Claims, 4 Drawing Sheets

(56) References Cited

U.S. PATENT DOCUMENTS

| | | | | |
|---|---|---|---|---|
| 9,545,532 | B2 * | 1/2017 | Miller | A63B 71/022 |
| 10,780,334 | B2 * | 9/2020 | Nilsson | A63B 1/00 |
| 2005/0148433 | A1 * | 7/2005 | Wang | A63B 5/11 482/27 |
| 2013/0316875 | A1 * | 11/2013 | Howell | A63B 5/11 482/27 |

* cited by examiner

TRAMPOLINE FRAME PADS

REFERENCE TO RELATED APPLICATION

This application claims priority to U.S. Applic. No. 62/846,951, which was filed on May 13, 2019. The contents of which are incorporated herein by reference.

FIELD OF THE INVENTION

The invention relates generally to trampolines. More particularly, the invention relates to trampoline frame pads that extend over trampoline frame components.

BACKGROUND OF THE INVENTION

Trampoline parks have become popular recreational venues throughout the country. Multiple fabric jumping mat sections are each connected by a large number of springs to a network of rigid metal supports some of which also use metal, cable or chain in the suspension of the trampoline jumping mats.

Each of the trampoline jumping mat sections creates a jumping surface, with an array of adjacent trampolines defined by the jumping surfaces and support network permitting users to travel from one jumping surface to another over a considerable area.

Consumer Product Safety Commission standards require trampoline frame pads to be placed over all of the metal frame surfaces, cables, chains, hooks and all springs to reduce the risk of injury should a person who is jumping on the trampolines inadvertently land on a frame or a portion of the suspension system instead of the trampoline fabric mat section.

The prior art trampoline frame pads 12, such as illustrated in FIG. 1, generally include a foam core over which a protective cover is placed. The protective cover has a zipper to close the protective cover after the foam core is inserted therein. The zippers very often fail. Web straps sewn to the underside of the pads and are provided to tie the cover to the trampoline frame. Over time, the foam core shrinks, which results in sagging or wrinkles forming on an upper surface of the protective cover 14. The sagging or wrinkled cover presents a potential injury risk to persons using the trampolines 10 but also degrades the appearance of the trampolines 10. Underside tying straps can be untied and retied simply to hold the pads firmly in place to the trampoline frame and serve no other purpose.

In the prior art an effort is made to reduce the sagging and wrinkles, separate straps 16 are placed around the trampoline frame pads 12 as illustrated in FIG. 1, to minimize the potential of users tripping on the straps 16 when jumping between trampolines 10, the straps 16 are generally placed proximate corners of the trampolines 10 and less often in the middle of sides on the trampoline 10.

Another technique to reduce sagging and wrinkles on the upper surface of the protective cover of the trampoline frame pad is to overfill the trampoline frame pad with layers of new and/or used foam. A drawback of this overfilling approach is that it results in the zipper becoming inoperable, and causes the upper surface of the trampoline frame pad to be more convex and in time even more wrinkled, which increases the risk of a person tripping or slipping when standing on the trampoline frame pad.

Especially when persons are playing games such as dodgeball on the trampolines where the persons jump around to avoid being hit by balls thrown at them, there is a greater risk of tripping on the sagging and wrinkled protective cover of the trampoline frame pad, the separate exterior straps, or on the arched upper surface of the overfilled trampoline frame pad.

SUMMARY OF THE INVENTION

An embodiment of the invention is directed to a trampoline frame pad system for use in conjunction with a trampoline having a jumping mat that is operably attached to a support frame. The trampoline frame pad system includes a foam core, a protective cover, a cover tightening mechanism and a primary pad attachment mechanism. The foam core has a first surface. The protective cover has an opening that is adapted to receive the foam core. The cover tightening mechanism is attached to the protective cover so that the cover tightening mechanism is capable of substantially tightening the protective cover over the first surface without the cover tightening mechanism extending over the first surface. The primary pad attachment mechanism is attached to the protective cover so that the primary pad attachment mechanism is capable of removably attaching the trampoline frame pad to the support frame.

Another embodiment of the invention is directed to a trampoline system that includes a support frame, a jumping mat and a trampoline frame pad system. The jumping mat that is operably attached to the support frame. The trampoline frame pad system includes a foam core, a cover tightening mechanism and a primary pad attachment mechanism. The foam core has a first surface. The protective cover has an opening that is adapted to receive the foam core. The cover tightening mechanism is attached to the protective cover so that the cover tightening mechanism is capable of substantially tightening the protective cover over the first surface without the cover tightening mechanism extending over the first surface. The primary pad attachment mechanism is attached to the protective cover so that the primary pad attachment mechanism is capable of removably attaching the trampoline frame pad to the support frame.

Another embodiment of the invention is directed to a method of assembling a trampoline. A jumping mat is operably attached to a trampoline support frame. A foam core is placed inside of a protective cover to form a trampoline frame pad. The protective cover has a cover tightening mechanism and a primary pad attachment mechanism attached thereto. The protective cover is substantially tightened over the first surface with the cover tightening mechanism without the cover tightening mechanism extending over the first surface. The trampoline frame pad is removably attached to the support frame with the primary pad attachment mechanism. The trampoline frame pad substantially covers the trampoline support frame to prevent a person who is on the jumping mat from contacting the trampoline support frame.

BRIEF DESCRIPTION OF THE DRAWINGS

The accompanying drawings are included to provide a further understanding of embodiments and are incorporated in and constitute a part of this specification. The drawings illustrate embodiments and together with the description serve to explain principles of embodiments. Other embodiments and many of the intended advantages of embodiments will be readily appreciated as they become better understood by reference to the following detailed description. The elements of the drawings are not necessarily to scale relative to each other. Like reference numerals designate corresponding similar parts.

DETAILED DESCRIPTION OF THE INVENTION

Figure 1:
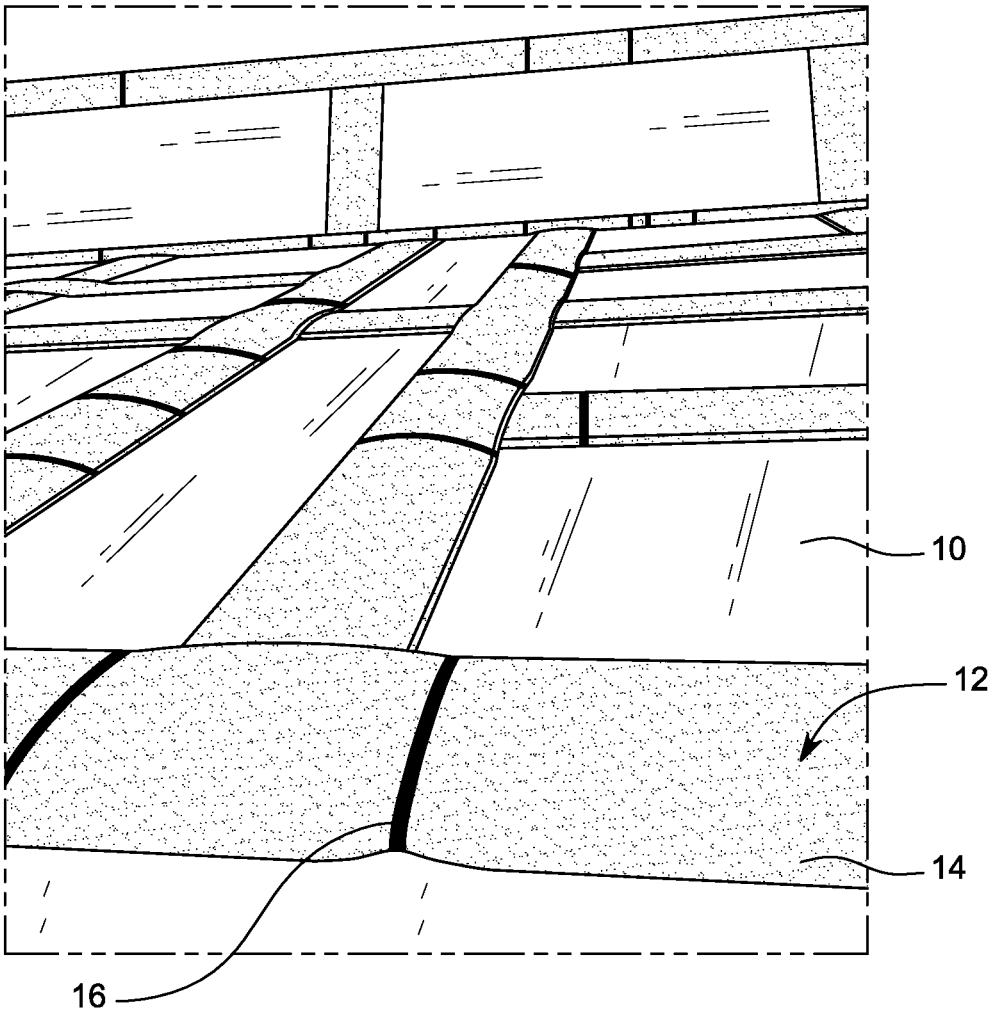
FIG. 1 (PRIOR ART)
FIG. 1 is an image of prior art trampoline frame pads used in conjunction with trampolines.
Figure 2:
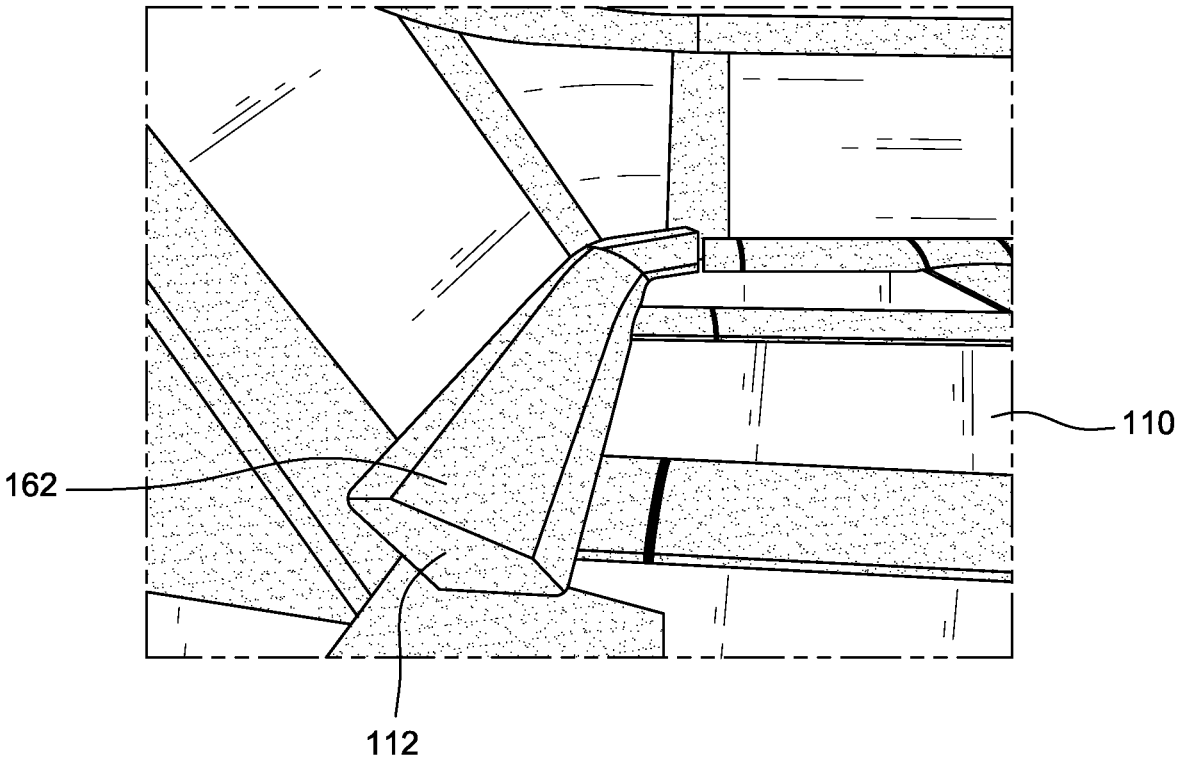
FIG. 2 is an image of trampoline frame pads in an installed configuration with trampolines according to an embodiment of the invention.
Figure 3:
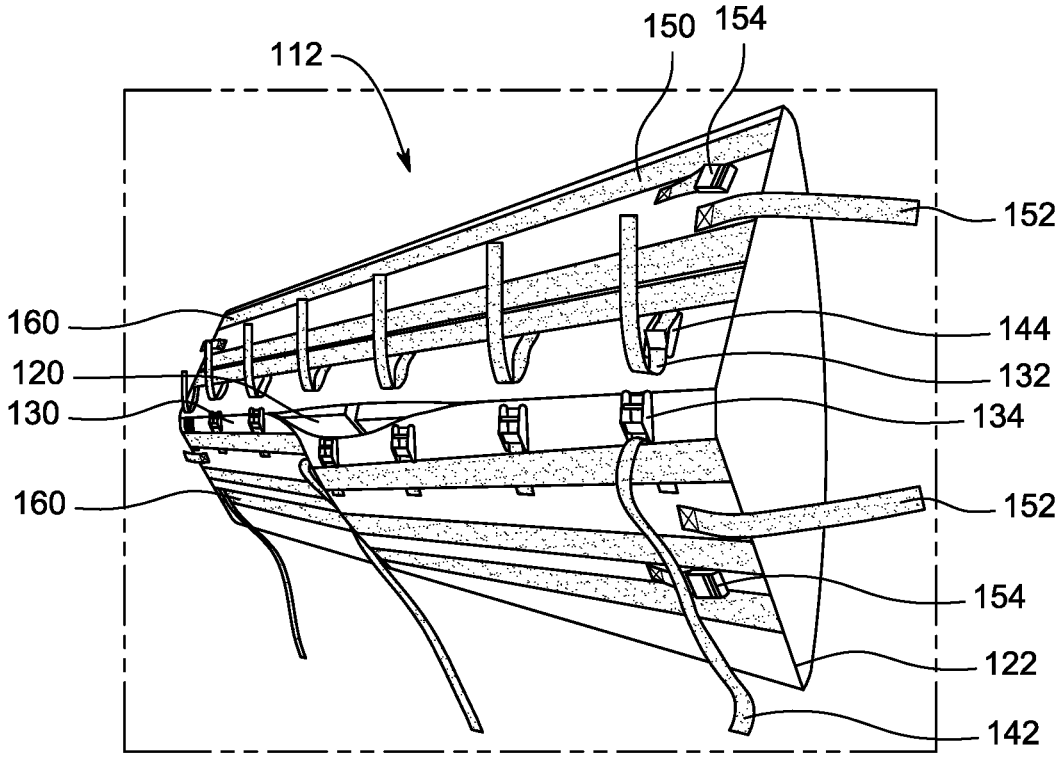
FIG. 3 is an image of a lower surface of an uninstalled trampoline frame pad with the first tightening mechanism to tighten a cover around a foam insert, a second tightening mechanism to attach the trampoline frame pad to the trampoline frame and a pad joining mechanism, where the first and second tightening mechanisms and the pad joining mechanisms are all in an unattached configuration.
Figure 4:
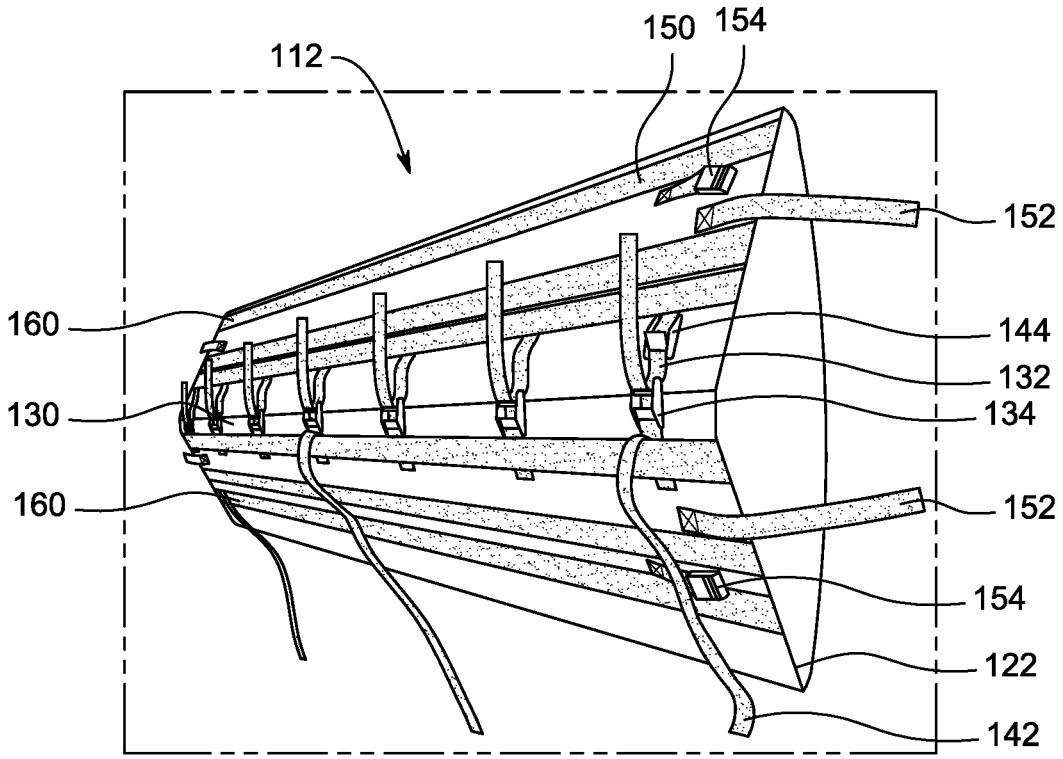
FIG. 4 is an image of the lower surface of the trampoline frame pad with the first tightening mechanism in an attached configuration and the second tightening mechanism and the pad joining mechanism in the unattached configuration.

An embodiment of the invention is directed to an enhanced trampoline frame pad 112 that is used in conjunction with at least one trampoline 110, as illustrated in FIG. 2. The trampoline frame pad 112 generally includes a foam core 120, a protective cover 122, a cover tightening mechanism and a primary pad attachment mechanism, as illustrated in FIGS. 3 and 4.

This invention enables the trampoline frame pads 112 to be installed and removed more quickly than the prior art trampoline frame pads. Because of the nature of trampoline parks, it is periodically necessary to remove and replace the trampoline frame pads 112.

This invention dramatically reduces the filling time of new or used trampoline frame pads when using used foam or new foam. Some trampoline parks will re-stack used foam or a combination of new and used foam to return used trampoline frame pads to a thickness that provides desired user protection often overfilling the pad and making the zipper inoperable.

This invention also enables the outer surface of the protective cover 122 to be easily maintained wrinkle free, substantially tightened in place and looking professional on an ongoing basis between periodic replacements of the foam core 120, the protective cover 122 or the entire trampoline frame pad 112.

A person of skill in the art will appreciate that a variety of types of material may be used in fabricating the foam core 120 to provide the trampoline frame pad 112 with a desired level of cushioning such that when a person walks or lands on the trampoline frame pad 112, the person is not injured caused by contact with the rigid trampoline frame components. An example of one suitable material that may be used in the foam core 120 is expanded polyethylene.

The foam core 120 may be formed in a variety of shapes depending on where the trampoline frame pad 112 is intended to be used on the trampoline 110. For example, when the trampoline frame pad 112 is intended to be used along the edge of the trampoline 110, the foam core 120 may have a generally triangular cross-sectional profile as illustrated in FIG. 2. Alternatively, when the trampoline frame pad 112 is intended to be used between adjacent trampolines 110, the foam core 120 may have a generally rectangular cross-sectional profile.

The protective cover 122 covers the foam core 120 and thereby protects the foam core 120 from damage. In certain embodiments, the protective cover 122 substantially covers the foam core 120. The protective cover 122 has an opening 130 on a lower surface thereof, as illustrated in FIGS. 3 and 4, which enables the foam core 120 to be placed into and removed from the protective cover 122 with ease.

The cover tightening mechanism is used to close and adjustably tighten the protective cover 122 around the foam core 120 using a combination of straps 132 and buckles 134. The cover tightening mechanism allows closure of the protective cover 122 and proper tensioning of the protective cover 122 around the foam core 120 during installation. In addition, the cover tightening mechanism allows for cover tightening maintenance from time to time to minimize wrinkles.

The protective cover 122 is fabricated from a durable material that resists damage for an extended period of time while the trampoline 110 is being used. In certain embodiments, the protective cover 122 is fabricated from vinyl-coated fabric.

The primary pad attachment mechanism consists of a longer strap 142 that is extended around the trampoline frame and inserted into buckle 144 to tighten and hold the trampoline frame pad 112 tightly to the trampoline frame. In addition, the primary pad attachment mechanism allows for protective cover 122 tightening maintenance from time to time to minimize gaps between the wall mat, the trampoline frame, and trampoline frame pad 112.

A pad joining mechanism consisting of straps 152 to be inserted into buckles 154 mounted on the adjacent trampoline frame pads 112 in a configuration as illustrated in FIG. 2. Depending on the length of the trampoline frame pad 112, there may be more than one pad joining mechanism enabling the trampoline frame pads 112 to be tightened together lineally to each other reducing gaps between the trampoline frame pads 112.

The straps 132, 142 and 152, and the shorter straps used to attach the buckles 134, 144 and 154 may be fabricated from a variety of materials with a variety of thicknesses and widths such that the straps 132, 142, 152 resist breakage during use of the trampoline 110.

The buckles 134, 144 and 154 are capable of releasably engaging the straps 132, 142 and 152. The buckles 134, 144 and 154 have an unlocked configuration and a locked configuration. A person of skill in the art will appreciate that the buckle 134, 144 and 154 may have a variety of configurations using the concepts of this invention. An example of one such suitable buckle 134, 144 and 154 is a cam buckle. The buckle 134, 144 and 154 may be directly attached to the protective cover 122 or may be attached to the protective cover 122 with a strap shown with buckle 134, 144 and 154.

The straps 142 may be attached to the protective layer 122 proximate the second edge of the opening 130 and the buckle 144 may be attached to the protective layer 122 proximate the first edge of the opening 130. Using such a configuration minimizes the potential of attaching the strap 142 to the buckle 134 or the strap 132 to the buckle 144.

It is possible to form at least a portion of the components of the cover tightening mechanism with a different color than at least a portion of the components of the primary pad attachment mechanism components. The colors should be sufficiently different such that a person can readily distinguish the cover tightening mechanism components from the primary pad attachment mechanism components. For example, the cover tightening mechanism components may be fabricated with the color red and the primary pad attachment mechanism components may be fabricated with the color green.

The lower surface of the trampoline frame pad 112 may also include a supplemental pad attachment mechanism 160 to minimize movement of the trampoline frame pad 112 with respect to the trampoline mat and/or prevent gaps between the lower surface of the trampoline frame pad 112 and the trampoline mat 110. The supplemental pad attachment mechanism 160 may have an elongated configuration with a length that is similar to the length of the trampoline frame pad 112. There may be more than one of the supplemental pad attachment mechanism 160 that are placed in a spaced-apart configuration.

An example of one suitable material that may be used for the supplemental pad attachment mechanism 160 is a hook and loop mechanism such as available under the trademark VELCRO 160. A first side of the hook and loop fastener is secured to the lower surface of the trampoline frame pad 112 and a second side of the hook and loop fastener is secured to the upper surface of the trampoline 110.

In operation, the foam core 120 is placed inside of the protective cover 122, as illustrated in FIG. 3. Each of the straps 132 are engaged with the associated buckle 134, as illustrated in FIG. 4, until the upper surface 162 of the trampoline frame pad 112 is substantially flat and wrinkle free, as illustrated in FIG. 2.

Next, the trampoline frame pad 112 is attached to the trampoline 110 by extending the straps 142 around the trampoline frame and then engaging the associated buckles 144 until the trampoline frame pad 112 is against the trampoline surface. The pad joining mechanism consisting of straps 152 to be inserted into buckles 154 are used in combination to secure adjacent ends of the trampoline frame pads 112 with respect to each other. The hook and loop securing mechanism 160 on the trampoline frame pad 112 and the trampoline 110 engage each other to substantially prevent movement of the trampoline frame pad 112 with respect to the trampoline 110.

After use of the trampoline 110 for an extended period, the foam core 120 shrinks so that wrinkles develop on the upper surface 162 of the trampoline frame pad 112. The trampoline frame pad 112 is separated from the trampoline 110 by disengaging the hook and loop securing mechanism and loosening the trampoline frame pads 112 by disengaging the pad attachment mechanism straps 142 and buckle 144. The cover tightening mechanism straps 132 are tightened with respect to the buckles 134 until the upper surface 162 of the trampoline frame pad 112 returns to the initial tightened and wrinkle-free configuration. Thereafter, the trampoline frame pad 112 is reattached to the trampoline 110 using the process set forth above.

Another aspect of the invention relates to a trampoline frame pad that includes a glow-in-the-dark feature that enables aspects of the trampoline frame pad to be seen in low light situations such as during trampoline sessions where the conventional lights are not used or are used a reduced intensity or an alternate color.

The glow-in-the-dark feature can also be used in conjunction with providing evacuation instructions so that persons using the trampolines can be directed to an exit such as when there is a power outage.

One option that may be used for fabricating the glow-in-the-dark material is phosphorescent materials. An advantage of the phosphorescent materials is that they do not need to be connected to an electrical energy source when used. In other embodiments, the glow-in-the-dark components are operably connected to an electrical energy source.

In certain embodiments, the glow-in-the-dark material is used to identify areas that are desired to stand out such as corners of the trampoline. The glow-in-the-dark material may include shapes, text or a combination thereof. For example, the glow-in-the-dark material may be in the form of circles.

The glow-in-the-dark material may be attached to the trampoline frame pad using a variety of techniques. An example of one suitable technique for attaching the glow-in-the-dark material to the trampoline frame pad is an adhesive.

In the preceding detailed description, reference is made to the accompanying drawings, which form a part hereof, and in which is shown by way of illustration specific embodiments in which the invention may be practiced. In this regard, directional terminology, such as "top," "bottom," "front," "back," "leading," "trailing," etc., is used with reference to the orientation of the Figure(s) being described. Because components of embodiments can be positioned in a number of different orientations, the directional terminology is used for purposes of illustration and is in no way limiting. It is to be understood that other embodiments may be utilized and structural or logical changes may be made without departing from the scope of the present invention. The preceding detailed description, therefore, is not to be taken in a limiting sense, and the scope of the present invention is defined by the appended claims.

It is contemplated that features disclosed in this application, as well as those described in the above applications incorporated by reference, can be mixed and matched to suit particular circumstances. Various other modifications and changes will be apparent to those of ordinary skill.

The invention claimed is:

1. A trampoline frame pad system for use in conjunction with a trampoline having a jumping mat that is operably attached to a support frame, wherein the trampoline frame pad system comprises:

a foam core having a first surface;

a protective cover having an opening that is adapted to receive the foam core;

a cover tightening mechanism comprising a first cover tightening component and a second cover tightening component that are both directly attached to the protective cover, wherein the first covering tightening component is capable of releasably engaging the second cover tightening component so that the cover tightening mechanism is capable of tightening the protective cover over the first surface without the cover tightening mechanism extending over the first surface; and a primary pad attachment mechanism comprising a first primary pad attachment component and a second primary pad attachment component that are both directly attached to the protective cover, wherein the first primary pad attachment component is capable of releasably engaging the second primary pad attachment component so that the primary pad attachment mechanism is capable of removably attaching the trampoline frame pad to the support frame.

2. The trampoline frame pad system of claim 1, wherein the first cover tightening component and the first primary pad attachment component each comprise a strap, wherein the second cover tightening component and the second primary pad attachment component each comprise a buckle and wherein each of the buckles is capable of releasably engaging the respective strap to retain the respective strap in a stationary position with respect to the respective buckle.

3. The trampoline frame pad system of claim 1, wherein the opening is defined by a first opening edge and a second opening edge that are located on opposite sides of the opening and wherein the first cover tightening component and the second primary pad attachment component are both attached to the protective cover closer to the first opening edge than the second opening edge.

4. The trampoline frame pad system of claim 1, wherein the first cover tightening component and the second cover tightening component are both located closer to the opening than the first primary pad attachment component and the second primary pad attachment component.

5. The trampoline frame pad system of claim 1, wherein the foam core further comprises a second surface that is oriented opposite the first surface, wherein the cover tightening mechanism and the primary pad attachment mechanism are both located along the second surface when the protective cover is attached to the foam core.

6. The trampoline frame pad system of claim 1, wherein the foam core further comprises a second surface that is oriented opposite the first surface, wherein the trampoline frame pad system further comprises a supplemental pad attachment mechanism attached to the protective cover over the second side of the foam core when the protective cover is attached to the foam core.

7. The trampoline frame pad system of claim 1, wherein the foam core further comprises an end and wherein the trampoline frame pad system further comprising a pad joining mechanism mounted to the protective cover proximate the end when the protective cover is attached to the foam core.

8. The trampoline frame pad system of claim 1, wherein when the foam core is inside the protective cover, the protective cover covers the foam core.

9. A trampoline system comprising:

a support frame;

a jumping mat that is operably attached to the support frame; and a trampoline frame pad system that comprises:

a foam core having a first surface;

a protective cover having an opening that is adapted to receive the foam core;

a cover tightening mechanism comprising a first cover tightening component and a second cover tightening component that are both directly attached to the protective cover, wherein the first covering tightening component is capable of releasably engaging the second cover tightening component so that the cover tightening mechanism is capable of tightening the protective cover over the first surface without the cover tightening mechanism extending over the first surface; and a primary pad attachment mechanism comprising a first primary pad attachment component and a second primary pad attachment component that are both directly attached to the protective cover, wherein the first primary pad attachment component is capable of releasably engaging the second primary pad attachment component so that the primary pad attachment mechanism is capable of removably attaching the trampoline frame pad to the support frame.

10. The trampoline system of claim 9, wherein the first cover tightening component and the first primary pad attachment component each comprise a strap, wherein the second cover tightening component and the second primary pad attachment component each comprise a buckle and wherein each of the buckles is capable of releasably engaging the respective strap to retain the respective strap in a stationary position with respect to the respective buckle.

11. The trampoline system of claim 9, wherein the opening is defined by a first opening edge and a second opening edge that are located on opposite sides of the opening and wherein the first cover tightening component and the second primary pad attachment component are both attached to the protective cover closer to the first opening edge than the second opening edge.

12. The trampoline system of claim 9, wherein the first cover tightening component and the second cover tightening component are both located closer to the opening than the first primary pad attachment component and the second primary pad attachment component.

13. The trampoline system of claim 9, wherein the foam core further comprises a second surface that is oriented opposite the first surface, wherein the cover tightening mechanism and the primary pad attachment mechanism are both located along the second surface when the protective cover is attached to the foam core.

14. The trampoline system of claim 9, wherein the foam core further comprises an end and wherein the trampoline frame pad system further comprising a pad joining mechanism mounted to the protective cover proximate the end when the protective cover is attached to the foam core.

15. A method of assembling a trampoline comprising:

operably attaching a jumping mat to a trampoline support frame;

placing a foam core inside of a protective cover to form a trampoline frame pad, wherein the protective cover has a cover tightening mechanism and a primary pad attachment mechanism attached thereto, wherein the cover tightening mechanism comprises a first cover tightening component and a second cover tightening component that are both directly attached to the protective cover and wherein the primary pad attachment mechanism comprises a first primary pad attachment component and a second primary pad attachment component that are both directly attached to the protective cover;

tightening the protective cover over the first surface with the cover tightening mechanism by releasably engaging the first cover tightening component and the second cover tightening component without the cover tightening mechanism extending over the first surface; and removably attaching the trampoline frame pad to the support frame with the primary pad attachment mechanism by releasably engaging the first primary pad attachment component and the second primary pad attachment component, wherein the trampoline frame pad covers the trampoline support frame to prevent a person who is on the jumping mat from contacting the trampoline support frame.

16. The method of claim 15, wherein the first cover tightening component and the first primary pad attachment component each comprise a strap, wherein the second cover tightening component and the second primary pad attachment component each comprise a buckle and wherein each of the buckles is capable of releasably engaging the respective strap to retain the respective strap in a stationary position with respect to the respective buckle.

17. The method of claim 15, wherein the foam core is placed inside of the protective cover through an opening, wherein the opening is defined by a first opening edge and a second opening edge that are located on opposite sides of the opening and wherein the method further comprises attaching the first cover tightening component and the second primary pad attachment component to the protective cover closer to the first opening edge than the second opening edge.

18. The method of claim 15, and further comprising attaching the first cover tightening component and the second cover tightening component closer to the opening than the first primary pad attachment component and the second primary pad attachment component.

19. The method of claim 15, wherein the foam core further comprises a second surface that is oriented opposite the first surface, wherein the cover tightening mechanism and the primary pad attachment mechanism are both located along the second surface when the protective cover is attached to the foam core.

* * * * *